United States Patent [19]

Mros

[11] 4,299,177

[45] Nov. 10, 1981

[54] STOKER STRUCTURE

[76] Inventor: Fredrick Mros, 3519 S. 700 East, Salt Lake City, Utah 84106

[21] Appl. No.: 157,491

[22] Filed: Jun. 9, 1980

[51] Int. Cl.[3] ..... F23K 3/00

[52] U.S. Cl. ..... 110/101 CF; 110/110; 110/182.5; 110/186; 110/328

[58] Field of Search ..... 110/101 CF, 101 CD, 110/105.6, 110, 328, 186, 188, 182.5; 141/125, 280; 414/350; 198/577, 523

[56] References Cited

U.S. PATENT DOCUMENTS

| | | | |
|---|---|---|---|
| 1,354,346 | 9/1920 | Skelly | 110/328 |
| 1,366,098 | 1/1921 | Ratel | 110/186 |
| 1,435,948 | 11/1922 | Van Brunt | 110/328 |
| 1,829,055 | 10/1931 | Parker | 110/182.5 |
| 1,922,960 | 8/1933 | Klein | 110/110 |
| 1,991,841 | 2/1935 | Burton | 110/110 |
| 2,344,328 | 3/1944 | Schrage | 110/101 CF |
| 3,272,355 | 9/1966 | Lesch et al. | 198/523 |

OTHER PUBLICATIONS

Detroit Single Retort Underfeed Stokers, Bulletin 615 pp. 1-10, a Division of United Industrial Corp.

*Primary Examiner*—Henry C. Yuen
*Attorney, Agent, or Firm*—M. Ralph Shaffer

[57] ABSTRACT

A screw-conveyor or auger feed and associated leveling system for underfeed stoker troughs receiving particulate, cominuted, or chunk material, such as "green" coal, by way of example, this for assuring a uniformly rising level of material relative to the trough. The stoker structure herein includes combustion beds which are air perforate and kept this way through periodically rising members such as tuyeres which shear or break up clinker-formation on such beds. A pneumatically-operated system may preferably be used to actuate such movable tuyeres relative to such combustion beds. Combustion air flows through the combustion beds upwardly but not over the trough; hot gasses rising rapidly from the combustion beds confine volatiles gently rising vertically from the cone within the trough for complete combustion, essentially eliminating smoke-production thereat.

4 Claims, 6 Drawing Figures

STOKER STRUCTURE

FIELD OF THE INVENTION

The present invention relates to auger feeds and leveling structure in general and, also, to underfeed stokers incorporating such feeds and having satisfactorily-operating burning structures.

BRIEF DESCRIPTION OF PRIOR ART

In the past many types of screw-conveyors or auger feeds have been devised for advancing crushed materials, for example, from a hopper or other source of supply to a trough or equivalent means whereby the advancing materials in the trough are progressively raised vertically for some use. Heretofore, and especially so far as coal-burning facilities are concerned, auger feeds have resulted in an uneven distribution or "piling-up" of materials in the trough or other structure receiving the same.

Accordingly, where the trough or receiving-structure comprises a retort "trough" in the industrial furnace art, there will be "cold spots" found at opposite ends of the trough structure where the fuel pile is intermediately disposed between such ends. Additionally, heretofore retort troughs have included upper-corner air tuyeres providing opposed air streams immediately over the upper region of the trough. This has proven disadvantageous since incomplete combustion of the mass of coke forming at the upper trough level produces smoking; more seriously, however, the "coke tree" build-up which rises at the top portion of the trough, is impervious to air-penetration and actually reflects back the air streams toward their tuyeres, creating a very high-heat condition at these tuyeres which actually burns them off, also causing even possible fracturing and even destruction of the trough proper owing to the high heat produced even within the trough. It has been found, relative to the above, that the present invention overcomes these and other difficulties by avoiding opposing air-streams over the trough and by confining any combustion at the retort trough proper, as produced by ambient furnace-temperatures, solely to the upper fuel level at the trough, thus leaving the retort trough proper relatively "cool" and less likely to fracture.

In essence, then, in prior retorts the air-receiving tuyeres proximate the edges of the retort structure and producing opposed air-streams tend to actually burn off, thus requiring extensive periodic re-work of the combustion equipment.

Also, in the prior art, the tuyeres are generally fixed, comprising a single bed proximate the coal retort as seen for example in the design of single-retort under-fed stokers as manufactured by Detroit Stokers of Monroe, Michigan, see the company's bulletin 615. This stoker design has provided for limited firing-bed wave movement, but does not allow for downward-sliding-elimination of clinker bed fragments, as provided herein.

Also, none of those of which the applicant is aware of provides for individual movable tuyeres that break up and eliminate the clinker bed formations on the combustion beds associated with the retort.

BRIEF DESCRIPTION OF INVENTION

According to the present invention, a retort-trough has a feed such as a screw conveyor, the end of which terminates proximate the center of the bin and at a lower area thereof. A second auger, by way of example, having flights of opposite pitches, is disposed above the first auger and spaced therefrom by a partition. Accordingly, fuel carried into the trough, or any other particulate or cominuted materials carried into the trough, and forming a pile-up in so doing, is distributed evenly toward the opposite ends of the trough so that a gradually ascending horizontal surface is achieved as to the materials introduced into such trough. Where this structure is applied to solid-fuel stokers such as coal stokers, by way of example, then the retort or trough is provided with one or more side-disposed combustion beds formed by stationary and also movable tuyeres the latter of which are caused to move periodically so as to break up clinker formations, thereby insuring continual air passage through the combustion bed to the coal layer deposit over such bed. Movable tuyeres may be periodically actuated so as to break up and eliminate clinker formations, and this is done preferably by a pneumatic system shown herein. Air tuyeres directing jets of air over the trough are avoided. Ambient furnace heat is relied upon to burn volatiles rising from the fuel in the trough; air turbulance over the trough is minimized so that smoking can be essentially eliminated.

OBJECTS

Accordingly, a principal object of the present invention is to provide an improved auger feed system.

A further object is to provide an auger feed and bin system which contribute to a uniformly rising materials level within such bin structure as employed.

An additional object is to provide a new and improved solid-fuels stoker structure.

An additional object is to provide stoker structure wherein the retort trough simply serves to provide an upper burning surface, the customary opposed air-streams thereover being purposefully omitted.

A further object is to provide retort structure wherein a trough or retort is supplied with one or a pair of side-combustion surfaces or beds formed of a series of elements certain ones of which are periodically raised so as to break up clinker formations on the so-composed combustion beds.

A further object is to provide a new and improved coal stoker structure.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood by reference to the following description, taken in connection with the accompanying drawings in which:

DETAILED DESCRIPTION OF PREFERRED EMBODIMENTS

Figure 1:
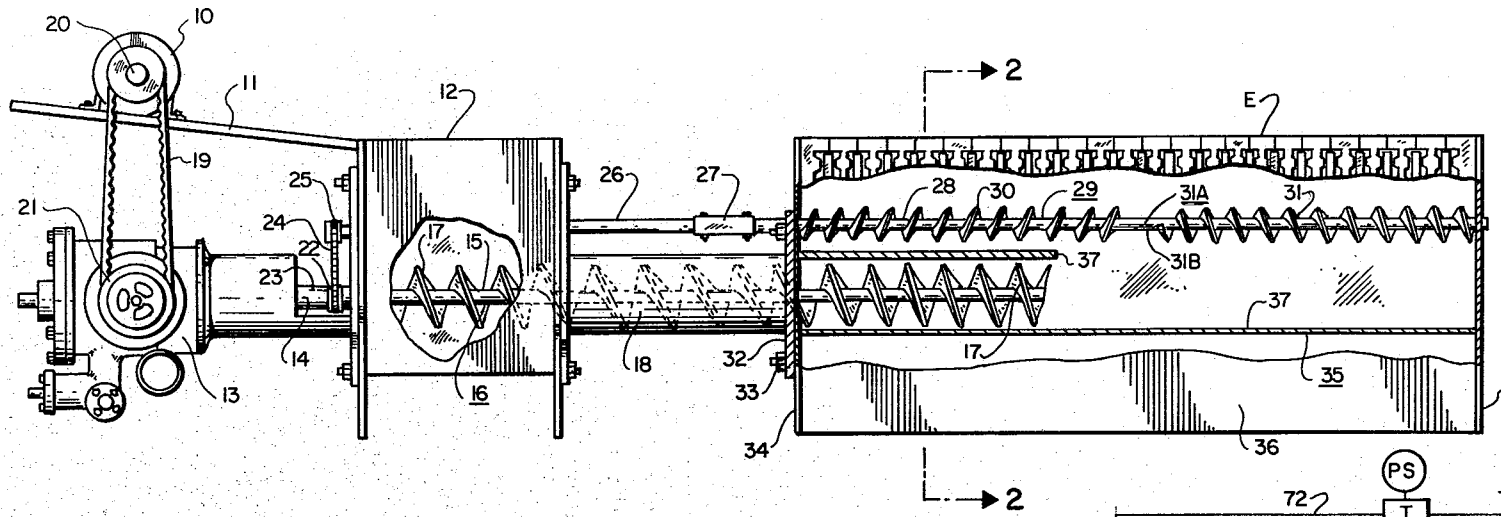
FIG. 1 is a side elevation, partially broken away for convenience of illustration, of certain auger feed and trough structure constructed in accordance with a preferred embodiment of the invention.

In FIG. 1 motor 10 is mounted to a platform 11 which may form a part of or a support for a ramp feed for hopper 12. Mounted to hopper 12 is a gear reducer 13 provided with sleeve 14 that encases an auger shaft 15, or its stub-shaft coupler, of screw-conveyor or auger feed means 16. The same includes auger flight 17 which, with the auger shaft, proceeds through and to the right of housing 18. Endless drive means 19 is coupled to shaft 20 of motor 10, via pulley or other means, and connects to the input drive 21 of gear reducer 13. A take-off gear or other coupler 22 is provided gear-reducer shaft 23, co-axially coupled to auger shaft 15, and itself is provided with an endless connector 24 which couples to gear 25 of shaft 26. Shaft 26 is connected by coupler 27 to the shaft portion 28 of auger leveling means or fuel-distributing auger 29, the same being provided with opposite auger flights 30 and 31. Housing 18 is mounted by flange 32 and attachments 33 to end plate 34 of retort trough structure or trough 35. The same may be a part of, supported by, or mounted to support structure 36. Support structure 36 is optional. Of importance is the fact that the bottom 37 is arcuate or curved, in preference, and is closely disposed to auger flight 17.

A partition or baffle 37 is supplied and is welded or otherwise secured to opposite side-walls, 38 and 39, of retort trough structure 35.

The upstanding walls 38 and 39 terminate in a horizontally-extended flange 40, 41 which serve to engage slots 42 of both the stationary and also the movable tuyeres 43, 44 of each of the two sloped air-pervious combustion beds 45 and 46.

Figure 2:
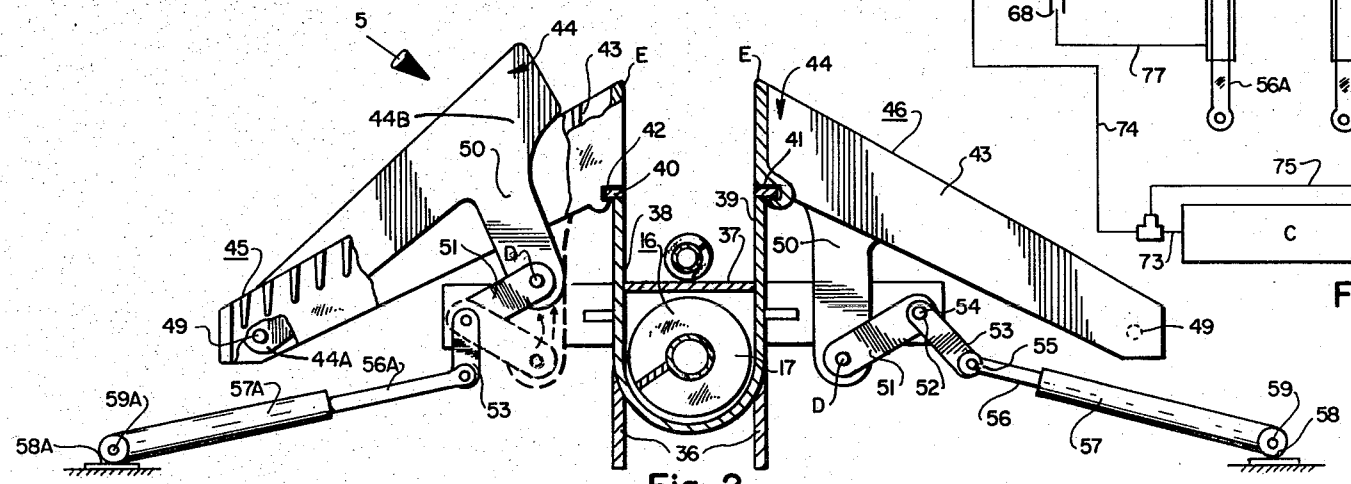
FIG. 2 is a transverse vertical section taken along the line 2—2 in FIG. 1, illustrating the structure as stoker structure, with side combustion beds having both fixed and movable side elements preferably taking the form of air-tuyeres or tuyeres.
Figure 6:
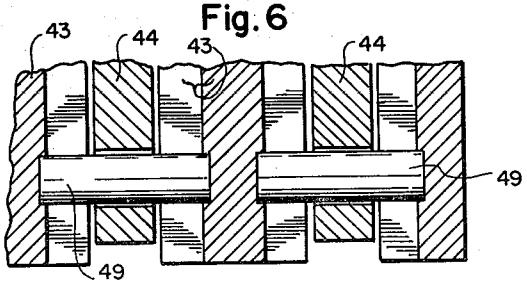
FIG. 6 is an enlarged fragmentary section taken along line 6—6 in FIG. 5, indicating a manner in which the movable tuyeres are pinned for rotational displacement relative to the fixed tuyeres or other fixed structure.

The sloped combustion beds or burning beds 45 and 46 allow for the receipt and gradual descent of solid fuel as builds up in the retort trough structure 35. Ribs 47, which form air slots 48 for the end and also intermediate-stationary tuyeres, accommodate air passage, by blower or simply natural means, upwardly through the combustion beds to the solid fuels gently cascading or moving downwardly thereover. The movable or shearing tuyeres 44, interspersed between tuyeres 43, are pivoted at outer ends 44A to the stationary tuyeres 43 by means of pins 49 which may be simply cast with the several tuyere structures 43 or simply comprise separate pins disposed in recesses as indicated, see FIG. 6. In any event, and whatever the manner of movable or pivotal attachment of the movable or shearing tuyeres 44 relative to the stationary tuyeres 43 or their support structure, the same include, depending from inner-upper portion 44B, integral tails 50 to which is respectively pivotally connected an arm 51, the latter being welded or otherwise fixed at 52 to lever 53. Levers 51 and 53, which may be fixed to their intermediate shaft 54, operate as the arms of a bell crank so that as a piston extremity 55, of piston rods 56 associated with cylinder 57, progresses outwardly, the same acts to rotate essentially the shaft, or pin, 54 in a clockwise direction, whereby to aid and in fact produce the upward movement of shearing tuyere 44 to the right of FIG. 2. In fact, the extension of the corresponding piston rod 56A of double-acting cylinder 57A in FIG. 2 is shown as having already been accomplished. The bases of double-acting pneumatic or hydraulic cylinders at 58 and 58A are secured by welding, bolts or other suitable means whereby the respective cylinders can become rotationally displaced about corresponding axes 59 and 59A.

Figure 3:
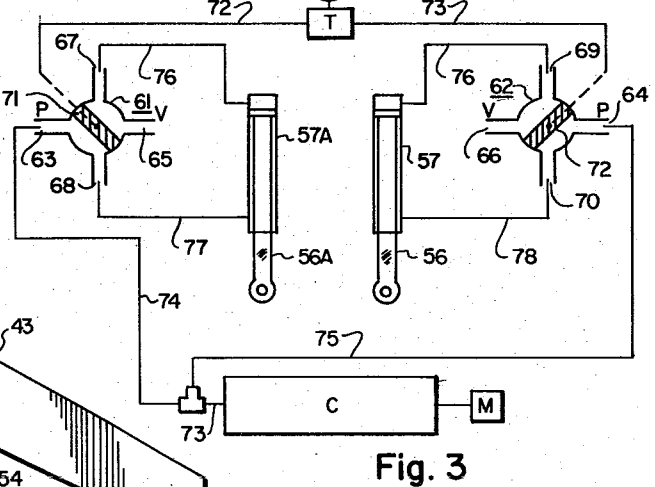
FIG. 3 is a schematic of a pneumatically-controlled system that may be incorporated in the structure of FIG. 2 so as to periodically move up and down the movable elements or tuyeres associated with the retort bin.
Figure 5:
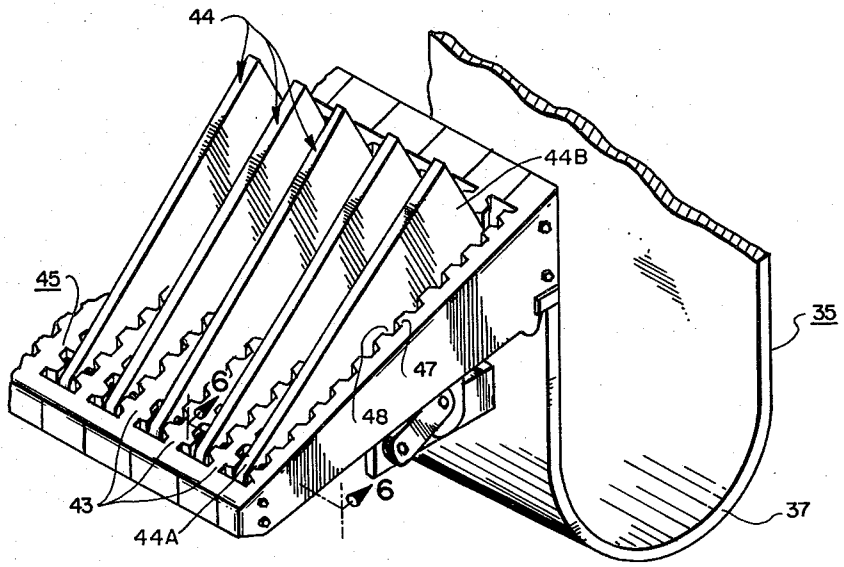
FIG. 5 is similar to FIG. 4 and is a view taken along the arrow 5 in FIG. 2, illustrating the raised ones of the movable tuyeres when so actuated by the pneumatic system of FIG. 3.
Figure 4:
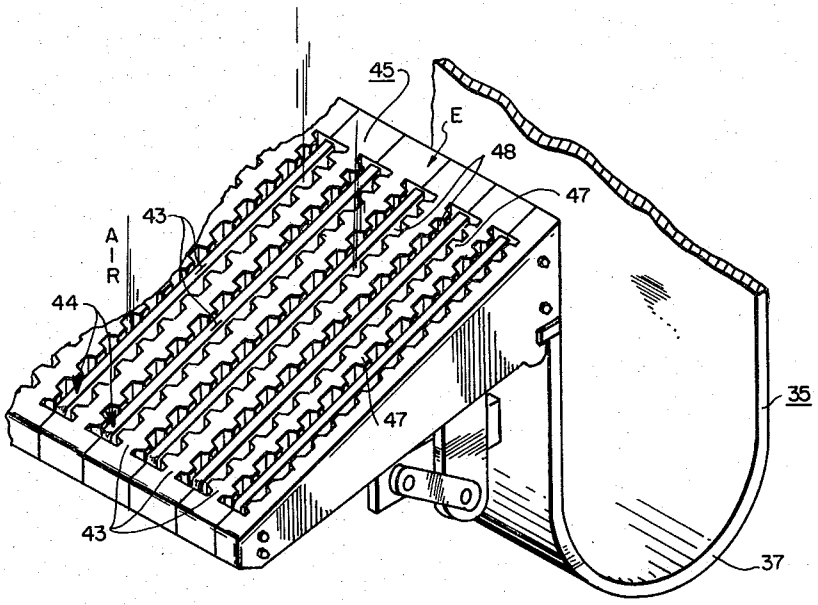
FIG. 4 is a fragmentary perspective view of a portion of the combustion bed employed with the retort of the structure of FIGS. 1 and 2.

FIG. 3 illustrates a representative control system that can pneumatically control the ascent and descent of the sets of movable or shearing tuyeres on opposite sides of retort trough structure 35 as seen from FIG. 4 progressing to FIG. 5. This is accomplished, in FIG. 3, in a sequential manner on opposite sides of retort trough structure 35. Thus, four-way solenoid valves 61 and 62 each include pressureports 63, 64, vent ports 65, 66, opposite cylinder end ports 67–68, 69–70, and also a solenoid operated valve element or unit 71, 72. Compressor C is driven by motor M and includes an output pressure line 73 to which are teed conduit 74 and 75 respectively leading to ports 63 and 64. Vents 65 and 66 are simply vented to the open atmosphere. Conduit 76 and 77 connect to opposite ends of double-acting cylinder 57A, whereas conduit 78 and 79 connect to opposite ends of cylinder 57 and lead to cylinder ports 69 and 70 as shown in FIG. 7. Conventional electrical circuits 72 and 73 lead to timer T which is coupled to a power source PS. Multiple-way solenoid valves are standard in the art as well as the electrical circuits and need no further elaboration. It is to be held in mind that while there is but a single cylinder on each side of the structure, see FIG. 2, this one cylinder may be used, and indeed is used in the embodiment shown, for lifting all of the tails or tail pieces 50 of all of the shearing tuyeres 44 on a respective side of such structure. This may be done by using a single shaft at D, respectively, or, where pins are employed thereat, simply using multiple links or multiple bell cranks relative to piston rod 56, by way of example. Whatever structure is employed, all of the shearing tuyeres on a respective side of the equipment are simultaneously lifted and then allowed to drop downwardly by virtue of the system shown in FIG. 7.

In operation, so far as FIG. 3 is concerned with the structure in related views, a settable timer T is employed to control the actuation of respectively solenoid valves 61, 62, for controlling the outward extension of piston rods 55, 55A in periodic fashion. When this is done, and in a slow manner, then there is less smoking and other disturbance of the various burning bed areas. Notwithstanding this, however, the clinker layer that is formed on each of the sloped burning beds 45 and 46, is periodically broken up or sheared, this is to allow for a general opening of the air perforations or slots 48, whereby to effect a controlled burning of the solid fuel particulate matter as the same gradually descends over the sloped burning or combustion beds 45, 56.

In operation as to the remainder of the equipment, coal is introduced into hopper 12 and advanced by screw conveyor 16 from the hopper through housing 18 into the retort trough structure 35. This is accomplished by auger flight 17 which is disposed at both extremities of housing 18. It is to be noted that the auger terminates at or less than half-way through the retort bin structure. This is so that there will be an even distribution from the pile of particulate solid fuel that forms intermediate the ends of the retort bin structure 35. As such pile builds up then the action of fuel distributing auger 29 comes into play so as to advance the solid fuel, such as particulate or crushed coal, to opposite ends of the bin structure by virtue of the oppositely pitched flights 30 and 31 relative to the auger portions disposed upon shaft 31A. Accordingly, instead of having "cold ends" at opposite ends of the retort or bin structure 35, the intermediate pile of fuel is simply evened out so as to result in a distribution of the fuel by auger flights 30 and 31 toward opposite ends of the bin structure, thereby essentially leveling the upper surface of the fuel.

It is important to note that the retort trough structure does not have any air jets or air apertures; hence, the same remains relatively cool, thus providing for simply conventional steel fabrication instead of expensive cast iron structure as has heretofore been employed. Furthermore, were the retorting done actually within a substitute trough structure, where opposed air jets or air tuyeres are employed at the upper corners of the trough, then heating here becomes very severe and the retort structure simply cracks under excessive heat and the tuyeres simply burn off. Likewise, volatiles as may be subject to combustion here aggravate the problem and might simply burn off any tuyeres disposed proximate the top of the retort.

It is most important to note that the present invention uses the double-auger structure as shown in FIG. 1 and also provides a baffle 37 so that material distributed by the returning auger flight of fuel distributing auger 29 will not fall back into the advancing auger lands or turns of fuel supply auger 16. In this way, particulate fuel returning by virtue of auguer flight 30 will perform its intended function of effecting a leveling of the overall upper surface level of the rising fuel. As the particulate fuel is caused to rise to upper surface or edges E, then the same simply spills over the top in opposite areas over the combustion beds 45 and 46. The only ignition at the top surface of the retort trough, over the rising level fuel, is due to ambient furnace temperatures, and will be insufficient in temperature to completely separate the components (including volatiles) of the upwardly moving green coal, thereby precluding coke masses from forming at the top of the trough; there is thus no "coke tree" formed here which would otherwise interrupt the flow of fuel to the combustion beds proper at 45 and 46, since the operating temperature is lower.

What is provided, therefore, is a "retort" trough structure wherein the latter in general simply comprises a fuel supply bin that is gradually fed by hopper 17 and in a manner to allow the fuel to rise in a horizontal level manner until the fuel approaches edges E to spill over onto the combustion beds 45 and 46. The solid fuel such as particulate coal is allowed to rise, and volatiles and any coal dust come up vertically from the green coal air-retained centrally over the trough between the hot-air blasts coming upwardly through the combustion beds, and hence undergo combustion, without smoking, at relatively low ambient furnace temperature over the rising level of fuel within structure 35; subsequently the fuel cascades downwardly over the combustion beds and is at that point or at those regions allowed to burn by rapid oxidation through the influence of incoming air which rises through air slots 48.

The many tuyeres comprising each combustion bed will generally be cast iron and may be made replaceable only if desired. Periodic risings of tuyeres 44 break up or shear the clinker beds so as to permit a relatively continuous flow of air through the beds to aid combustion purposes.

Trough 35 is free of air jets for the reasons hereinbefore mentioned and includes opposite ends 34, 34A, see FIG. 1. Augers 16 and 29 may be referred to simply as an auger feed means or screw conveyor and auger leveling means, respectively. As to the latter, shaft 31A has an auger flight common junction or shaft portions 31B. Also, as seen in FIG. 4, the stationary tuyeres may be bolted together as a single unit.

While particular embodiments of the present invention have been shown and described, it will be obvious to those skilled in the art that changes and modifications may be made without departing from this invention in its broader aspects, and, therefore, the aim in the appended claims is to cover all such changes and modifications as fall within the true spirit and scope of this invention.

I claim:

1. Coal-burning structure comprising an air-jet free, solid-fuel-receiving retort trough, free of transverse air jets thereacross, and having opposite upper side edges; means for progressively introducing a stream of coal into said retort trough; means disposed in said trough for leveling received coal therein; a pair of outwardly-downwardly sloping air-perforate combustion beds, respectively disposed adjacent to and on opposite sides of said retort trough, for receiving coal rising within said retort trough and cascading over said trough edges, said combustion beds each comprising a series of elongate tuyeres interspersed ones of which are elevatable within respect to other ones of said tuyeres, said interspersed ones of said tuyeres having outer horizontally-supported ends and inner-upper portions; and movable means for periodically elevating said inner-upper portions of said interspersed ones of said tuyeres, whereby to shear any clinker bed formed thereon.

2. The structure of claim 1 wherein said tuyeres are removable and have upper ends releasably mounted to said trough.

3. Coal-burning structure comprising an air-jet free solid-fuel-receiving retort trough, free of transverse air jets thereacross, and having opposite upper side edges; means for progressively introducing a stream of coal into said retort trough; means disposed in said trough for leveling received coal therein; an outwardly-downwardly sloping air-perforate combustion bed disposed adjacent to said retort trough at a side thereof, for receiving coal rising within said retort trough and cascading over a respective one of said trough edges, said combustion bed comprising a series of elongate tuyeres interspersed ones of which comprise clinker-bed-shearing means which are elevatable with respect to other ones of said tuyeres, said interspersed ones of said tuyeres having outer horizontally-supported ends and inner-upper portions; and movable means for periodically elevating said inner-upper portions of said interspersed ones of said tuyeres.

4. The structure of claim 3 wherein said outer ends are pivotally mounted.

* * * * *